United States Patent [19]

Buckle

[11] Patent Number: 4,945,851

[45] Date of Patent: Aug. 7, 1990

[54] SUBMERSIBLE INFLATABLE CRAFT

[75] Inventor: Brian L. Buckle, Colwyn Bay, United Kingdom

[73] Assignee: Budyco (Divers) Limited, Colwyn Bay, United Kingdom

[21] Appl. No.: 224,910

[22] Filed: Jul. 27, 1988

[30] Foreign Application Priority Data

Jul. 27, 1987 [GB] United Kingdom ..... 8717714

[51] Int. Cl.[5] ..... B63B 7/08

[52] U.S. Cl. ..... 114/345; 114/333; 251/61.3; 441/41

[58] Field of Search ..... 114/330, 331, 332, 333, 114/345; 441/40, 41, 42; 137/81.2, 236.1; 251/61.1, 61.2, 61.3

[56] References Cited

U.S. PATENT DOCUMENTS

| | | |
|---|---|---|
| 1,363,958 | 12/1920 | Dalen . |
| 2,364,211 | 12/1944 | Gustafson . |
| 2,975,958 | 3/1961 | Kane . |
| 3,204,862 | 9/1965 | Hadeler . |
| 3,257,672 | 6/1966 | Meyer et al. . |
| 3,436,776 | 4/1969 | Davis . |
| 4,045,835 | 9/1977 | Flam et al. . |
| 4,469,124 | 9/1984 | Bronaky et al. . |
| 4,527,582 | 7/1987 | Buckle et al. . |
| 4,674,429 | 6/1987 | Buckle et al. . |
| 4,677,931 | 7/1987 | Buckle . |

FOREIGN PATENT DOCUMENTS

| | | |
|---|---|---|
| WO8503049 | 7/1985 | PCT Int'l Appl. . |
| WO8706557 | 11/1987 | PCT Int'l Appl. . |
| 2101533 | 1/1983 | United Kingdom . |
| 2111174 | 6/1983 | United Kingdom . |
| 2126534 | 3/1984 | United Kingdom . |

*Primary Examiner*—Sherman D. Basinger
*Assistant Examiner*—Thomas J. Brahan
*Attorney, Agent, or Firm*—Cushman, Darby & Cushman

[57] ABSTRACT

A water craft including an inflatable buoyancy chamber, by inflation and deflation of the buoyancy chamber the buoyancy of the craft, floating or submerged, can be regulated. The water craft includes a buoyancy control apparatus for controlling inflation and deflation of the buoyancy chamber via air supplied by a source of compressed gas. The buoyancy control apparatus includes an operator actuable control which sends control signals to a venting device, to a descent device, to an ascent device or to a hovering device.

29 Claims, 5 Drawing Sheets

SUBMERSIBLE INFLATABLE CRAFT

FIELD OF THE INVENTION

The present invention relates to a submersible inflatable craft.

BACKGROUND OF THE INVENTION

Inflatable water craft provide a convenient means of transport for personnel in a variety of circumstances. They generally comprise one or more inflatable wall members providing the necessary buoyancy and a floor member which may be a rigid hull member or which may be a soft hull member, e.g. a flexible membrane.

It is believed that to date, such craft have been restricted in their operations to the surface. We have now devised a system by which a craft of this kind can be submerged in a controlled manner below the water surface, e.g. for concealment, and may be caused to ascend to the surface in a controlled manner for use.

SUMMARY OF THE INVENTION

The present invention provides a water craft including an inflatable buoyancy chamber, by inflation and deflation of which buoyancy chamber the buoyancy of the craft floating or submerged in water may be regulated, buoyancy control apparatus for controlling inflation and deflation of said buoyancy chamber, and a source of compressed gas connected via said control apparatus to said buoyancy chamber, wherein said buoyancy control apparatus comprises:

(1) means responsive to a control signal to produce venting of said buoyancy chamber;

(2) buoyancy increasing means responsive to a control signal to introduce gas from said source of compressed gas to said buoyancy chamber;

(3) means actuable by a control signal for controlling the descent of the craft in water, including means for sensing the rate of descent, and providing a control signal to actuate said buoyancy increasing means when said rate of descent exceeds a predetermined value;

(4) means actuable by a control signal for controlling the ascent of the craft in water and including means for sensing the rate of ascent and providing a control signal to activate said venting means when said rate of ascent exceeds a predetermined value;

(5) means for producing hovering of said craft submerged in water comprising means for sensing descent and producing a control signal to activate said buoyancy increasing means and means for sensing ascent and producing a control signal to activate said venting means; and (6) operator actuable control means for producing control signals for actuating selected ones of said venting means, buoyancy increasing means, descent control means, ascent control means and hover means to select between the functions of descent at a controlled rate, ascent at a controlled rate, and hovering.

BRIEF DESCRIPTION OF PREFERRED EMBODIMENTS

Preferably, the buoyancy control apparatus further includes means for delaying activation of the descent control means, ascent control means and/or hover means after the production of a control signal for the activation thereof by the operator actuable control means until a preselected depth has been reached.

The ascent control means may comprise means monitoring the rate of ascent by sensing reactive thrust of water on the said means consequent upon the rate of ascent and providing a control signal when the ascent speed exceeds a predetermined value, and a gas control valve responsive to said signal to provide pneumatic actuation of said venting means, connected to said venting means, said venting means being responsive to said signal to vent gas from the chamber to reduce the buoyancy and comprising a pneumatically actuable venting valve adapted to vent gas from the gas chamber when actuated.

The monitoring means may comprise a diaphragm which, in the ascent attitude of the device, extends laterally of the direction of the ascent and is exposed at its upper face to the ambient fluid whereby movement of the device in the ascent direction urges the diaphragm downwardly.

The lower face of the diaphragm also may be open to ambient fluid.

The control signal may be provided by movement of a rigid actuating member extending from and movable with the diaphragm.

The rigid actuating member may act directly on the gas control valve.

The gas control valve may be a normally closed two-way poppet-type whisker valve in which the whisker is engaged by the actuating member.

Preferably, the ascent control means is a device having means for monitoring the rate of ascent of the buoyancy apparatus and providing a control signal when the ascent velocity exceeds a predetermined speed, connected to said venting means controlling the venting of gas from the gas chamber, said venting means being responsive to said signal to vent gas from the chamber to reduce buoyancy, wherein the monitoring means has a velocity member which, in the ascent attitude of the device, extends laterally of the direction of ascent, and is supported in an equilibrium position for movement upwardly and downwardly, said velocity member being exposed at its upper face to the ambient fluid whereby sufficiently rapid movement of the device in the ascent direction urges the velocity member downwardly to produce said control signal, wherein the monitoring means also comprises a control valve comprising an inlet for connection to a source of pressurised gas, a chamber communicating with said inlet and containing a piston moveable between a valve-closed position and a valve-open position, a gas supply line for communicating said control signal to said venting valve means exiting from said piston containing chamber, there being a flow path for gas from said inlet to said gas supply line which is shut off from said inlet when the piston is in the valve-closed position and opened for gas flow from said inlet when the piston is in the valve-open position, a valved outlet for said piston containing chamber remote from the said inlet and normally closed by a valve, said valve being operable by movement of said velocity member to open the valve, gas bleed means providing restricted gas communication from said inlet to the face of the piston remote from the inlet, and biassing means biassing the piston to the valve-closed position, whereby upon opening of the valve which normally closes said valved outlet by movement of the velocity member the piston is displaced to the valve-open position by gas pressure from said inlet to communicate said inlet and said gas supply line, and wherein the venting valve means controlling the venting of gas from the gas chamber is responsive to gas pressure in said gas supply line to produce said venting.

Preferably, the velocity member has a rigid actuating member extending from it and movable with it to act directly or indirectly on the control valve.

Preferably, the valve for said valved outlet of said piston containing chamber is a whisker valve having a valve stem connected to the velocity member and a valve head and seat adapted to be unseated by deflection of the valve stem.

Preferably, the venting means is a valve including a chamber connected to said gas supply line, said chamber being bounded by a flexible diaphragm operable to open the venting means upon increase of pressure in the chamber.

The venting means may be a valve including a chamber connected to said gas supply line, said chamber being bounded by a piston movable in a cylinder, said piston being operable to open the venting valve means upon increase of pressure in the chamber.

The descent control means may be the same as the ascent control means but mounted in an inverted position and connected to supply gas to an inlet valve for inflating the buoyancy chamber instead of to the venting valve means.

The venting means may be a conventional remotely actuated, e.g. pneumatically actuated, venting valve but is preferably a venting valve apparatus comprising a main gas flow path which extends from an inlet to the venting valve for vented gas to an outlet from the venting valve apparatus, a valve normally closing said flow path, and actuating means for opening said valve, wherein there is a subsidiary flow path extending from a subsidiary gas inlet to a subsidiary gas outlet opening within the main flow path upstream of the valve, so constructed and arranged that application of gas pressure to said subsidiary inlet will produce or enhance flow of vented gas through said main flow path when said valve is open.

The arrangement may be such that the production or enhancement of gas flow is due to a venturi effect.

The actuating means may be adapted for pneumatic operation and the actuating means may be adapted to open said valve upon application of gas pressure to said subsidiary inlet.

The subsidiary flow path preferably communicates with a variable volume chamber, having a movable wall portion to which is mounted a control member connected to open said valve upon movement of said wall portion by pressurisation of said chamber, said subsidiary flow path extending from upstream of said wall portion to downstream of said wall portion.

There may be a bore through a portion of the control member constituting a portion of the subsidiary flow path and extending from the chamber to downstream of the movable wall portion.

The said bore may exit from the control member in a region where the control member is surrounded by a shield member for deflecting gas flow from the control member toward the valve.

The means for producing hovering of the craft may comprise a further upward movement sensing device connected to activate said venting means and generally resembling the ascent control means discussed above but being sensitive to a very small upward velocity coupled with means for sensing downward movement generally resembling the descent control means described above but, again, being sensitive to very small downward velocity.

If the ascent control means and descent control means described above are made sufficiently sensitive to upward and downward velocity respectively, simultaneous activation of both will enable them to act in synchrony to provide the means for hovering.

The means for delaying activation of the various control components described above after the production of a control signal by the operator for the activation thereof until a preselected depth has been reached may serve to interrupt the gas supply to each of the various control components until the required depth has been reached and may comprise a pressure sensitive gas supply device, incorporating a gas supply valve and adapted to open the gas supply valve when the device reaches a predetermined depth in water, comprising (i) a substantially fixed volume, closed gas reservoir containing a quantity of gas at substantially a predetermined pressure, (ii) pressure sensing means monitoring the difference in pressure between gas in said reservoir and the ambient fluid, said sensing means providing a control signal when the pressure of the ambient fluid exceeds the pressure of the gas reservoir, and (iii) a gas supply valve which is responsive to said signal to become opened.

Said gas supply valves may be connected to the gas inlets respectively of one or more of the ascent control means, descent control means, and hover means, preferably at least the latter two.

Means may be included for adjusting the pressure of gas in said gas reservoir.

Said pressure sensing means may comprise a flexible diaphragm which has one major surface exposed to the ambient fluid and which has its other opposed major surface exposed to the gas of the gas reservoir.

The gas reservoir may have a wall with an opening or openings therein, and said diaphragm may be mounted on said wall covering the or each said opening.

A rigid actuating member may extend from and be moveable with said diaphragm, said actuating member acting directly or indirectly on said gas supply valve.

Said actuating member may act on switching means controlling said gas supply valve.

Said gas supply valve may be disposed within said gas reservoir.

Over-ride means may be included for acting on said gas supply valve, to open it, independently of provision of said signal.

The craft is preferably an outboard motor powered inflatable.

BRIEF DESCRIPTION OF THE DRAWINGS

The invention will be illustrated by the following description of a preferred embodiment with reference to the accompanying drawings in which.

DETAILED DESCRIPTION OF PREFERRED EMBODIMENTS

Figure 1:
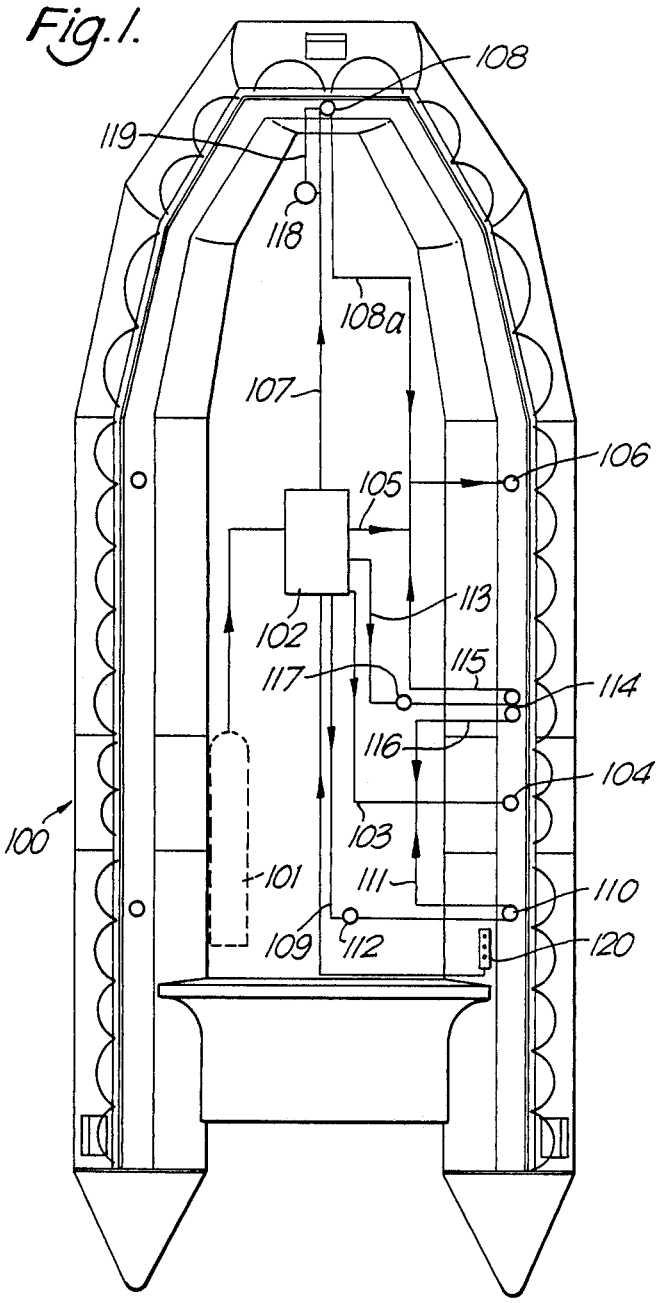
FIG. 1 is a plan schematic view of a craft according to the invention.

As shown in FIG. 1, a hard hulled inflatable craft 100 is equipped with a system according to the invention to enable it to be submerged and resurfaced in a controlled manner. The system comprises a compressed air cylinder 101 connected to a control unit 102 containing a regulator for lowering the pressure received from the cylinder 101 to a lower supply pressure which is constant with respect to ambient pressure and containing remotely actuable switching valves for communicating the supply pressure along various outlet lines in order to perform the various functions hereafter described.

A first outlet line 103 communicates with a gas inlet valve (inflation valve) 104 which is essentially simply a non-return valve communicating with the inflatable portion of the boat and through which gas from the cylinder 101 may be directed to inflate the inflatable chambers of the hull. At least as many inlet valves 104 as there are separate inflatable compartments in the water craft will normally be provided. Only one is shown for simplicity. A second gas line 105 from the control unit 102 is directed to the actuating inlet of a venting valve 106 which responds to pressure in its inlet line by venting gas from the inflatable chamber of the water craft. Once again, at least as many venting valves 106 will normally be provided as there are inflatable compartments but only one is shown for simplicity. The structure of a suitable venting valve will be described in detail hereafter.

Figure 4:
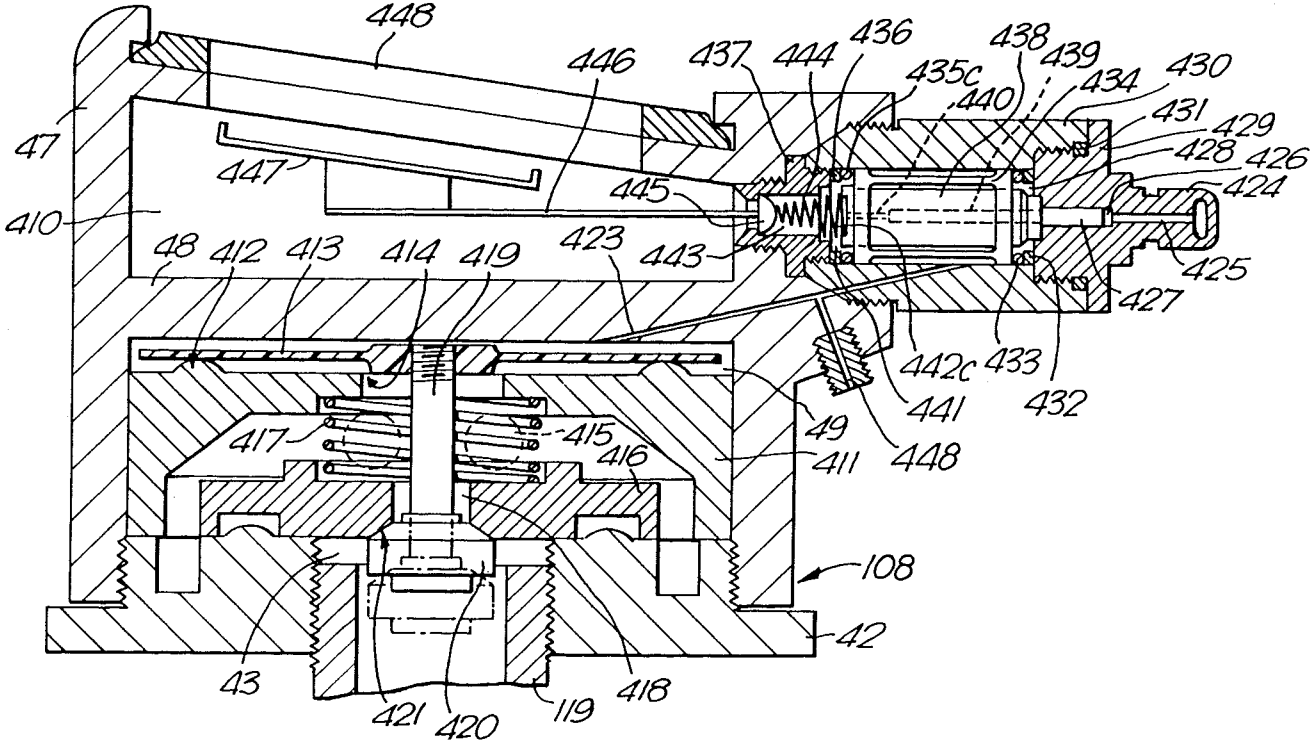
FIG. 4 is a cross-section through an ascent control valve for use in the craft according to FIG. 1.

A third gas line 107 communicates from the control unit 102 to an ascent control valve 108. Ascent control valve 108 will be described in more detail hereafter. It may have an outlet gas line **108*a* through which it can communicate gas pressure from the control unit 102 to the inlet of the venting valve 106** (or to several such venting valves) to actuate the venting valve and/or it may incorporate its own venting valve as shown in FIG. 4.

A further gas line 109 extends from the gas control unit to the inlet of a descent control valve 110 which will be described in more detail hereafter. Descent control valve 110 has an outlet line 111 by means of which it may communicate gas pressure from the control unit 102 to the inlet of the inflation valve 104 for inflation of the inflatable chamber of the craft. Interrupting line 109 is a depth limiting valve 112 to be described in more detail hereafter.

A final gas outlet line 113 from the control unit 102 communicates to the actuating inlet of a hover control valve 114 which has two outlet lines by means of which gas pressure may be communicated from the control unit 102. The first of these (115) communicates with the actuating inlet of the venting valve 106 and the second 116 communicates with the inlet of the inflation valve 104. A further depth limiting valve 117 is provided interrupting line 113.

Finally, a hand control unit 120 is shown connected via a cable with the control unit 102 for controlling its various functions. In addition, control unit 102 may be responsive to remotely transmitted signals from a suitable transmitter such as a sonar transmitter which may be used for instance by a diver out of the boat in the water.

The various functions performed by the water craft illustrated will now be described, following which a detailed description of the structure of the various valves required will be given.

Following inflation of the boat in the usual manner, the boat may be sailed on the surface using a conventional outboard motor until a position is reached at which it is desired to sink the boat for a period. The occupant may then direct the control unit 102 by using the hand control 120 to operate the venting valve 106 to render the boat non-buoyant so that it begins to sink. To control the rate of descent, the control unit 102 will direct gas pressure through the line 109 to the descent control valve 110. Initially this gas pressure will be interrupted by the closure of the depth limiting valve 112. Valve 112 will respond to increasing depth pressure and will open at a preselected depth communicating gas pressure from the control unit 102 to the descent control valve 110. Descent control valve 110 is positioned on the underside of the boat and monitors the rate of descent as described in detail hereafter. Upon sensing an excessive rate of descent, which it will probably do immediately, it communicates gas pressure through the line 111 to the inflation valve 104 so that the reinflation of the boat commences. The added buoyancy slows the rate of descent. It will be appreciated that a flexible inflated structure such as the water craft now described, once non-buoyant and submerged has a natural tendency to sink at an accelerating rate as the increasing water pressure compresses the inflatable structure and renders it less and less buoyant. Descent control valve 110 prevents this rapid descent by progressively introducing air through the inflation valve 104. By this means, the boat may be sunk to the bottom of the water.

Alternatively, starting from the surface, the user may program the control unit to achieve hovering at a preselected depth. To achieve this, gas pressure is communicated by the control unit through line 113 to the hover control valve 114 but is interrupted by depth limiting valve 117. As the boat sinks to the required depth, the depth limiting valve 117 communicates gas pressure to the inlet of the hover control valve 114 which will sense both descent and ascent of the boat. Sensing descent it will communicate gas pressure through the line 116 to the inflation valve 104 and will continue to do so until sufficient buoyancy has been introduced that descent ceases. The boat may start to rise. At that point, it will sense the ascent of the boat and will communicate gas pressure through line 115 to the inlet of the venting valve 106. Venting valve 106 will respond by venting gas from the buoyancy chambers of the boat to halt the ascent and perhaps bring about descent. Gradually, the position will stabilise by alternate application of pressure to the lines 115 and 116 and the boat will hover. Lateral movement during hovering may be restrained by anchors on the bottom without preventing the hovering action.

By transmitting a suitable signal by sonar, the occupant may retrieve the boat to the surface either from the hovering position or from the bottom. Control unit 102 will respond by communicating gas pressure through the line 107 to the ascent control valve 108. It will also communicate gas pressure through the line 103 to the inflation valve 104 for a period sufficient to render the boat buoyant. Once the boat commences to rise, the rate of rise will be controlled by the ascent control valve 108. At this point no further gas need be introduced through the line 103 and the inflation valve 104 since once the boat starts to rise, it will become progressively more buoyant as the water pressure acting on it decreases. Ascent control valve 108 is adapted to sense a predetermined rate of upward movement of the boat and to respond by communicating gas pressure from the control unit 102 to the actuating inlet of the venting valve 106 to progressively release buoyancy so as to prevent an excessive rate of rise and so as to prevent the air pressure in the boat bursting the inflatable compartments as the water pressure on it decreases.

The structure of the individual components will now be described in more detail.

Figure 2:
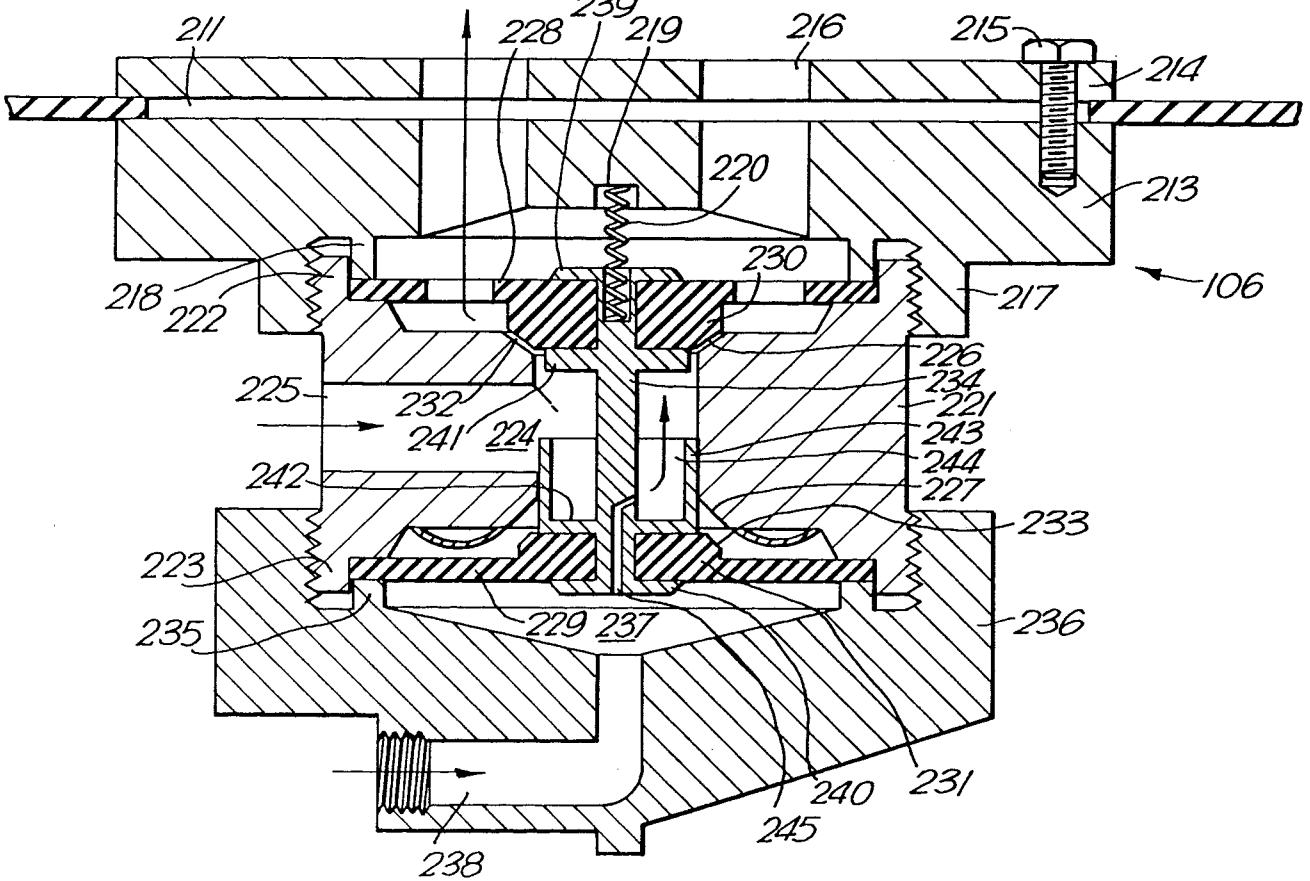
FIG. 2 is a cross-section through a venting valve for use in the craft of FIG. 1.

FIG. 2 shows a venting valve for use in the invention to be positioned in the skin of an inflatable chamber of the boat.

As shown in FIG. 2, venting valve apparatus 106 is mounted over a circular aperture 211 in the hull membrane of an inflatable boat. The apparatus comprises a first body portion 213 generally circular in shape mounted to the internal side of the hull over the aperture 211 and a mounting disc 214 of size corresponding to the first body portion 213 bolted thereto by bolts 215 located around the periphery of the mounting disc 214. The mounting disc 214 and the first body portion 213 are provided respectively with a ring of through apertures 216 which overlap to provide a gas flow path through the assembly of the mounting disc and first body portion.

The first body portion 213 has on its face remote from the mounting disc 214 an upstanding cylindrical flange 217 which is threaded on its internal cylindrical face. Concentric with flange 217 and spaced therefrom by an annular gap is a second upstanding cylindrical flange 218. Inboard of the circular flange 218, the surface of the first body portion is dished and in a central region there is provided a cup 219 for receiving one end of a compression coil spring 220.

Screwed into the thread in the flange 217 is a generally cylindrical valve body member 221 having outwardly threaded portions on either end. The top and bottom surfaces of the valve body member are inwardly recessed and surrounded by peripheral flanges 222, 223. A central wide bore 224 extends axially through the valve body. A transverse radially extending bore 225 extends generally centrally intermediate the ends of the cylindrical valve body member communicating the exterior cylindrical face with the central bore. The transverse bore is defined laterally by a pair of radii of the cylindrical valve body member extending at a little under 90° to one another and the bore is divided by a radially running bulk head (not shown) so as not unduly to weaken the valve body.

A pair of frusto conical valve seats are provided in the valve body facing in opposite directions and located in the top and bottom surfaces of the valve body at 226, 227. For each valve seat there is provided a rubber diaphragm 228, 229 having a central cylindrical boss 230, 231 terminating in a frusto conical valve member surface 232, 233 seated within a respective frusto conical valve seat 226 227. The two rubber diaphragms 228, 229 are joined by a centrally extending control rod 234 as will be described in more detail hereafter. Diaphragm 228 is apertured to allow air to flow therethrough.

The periphery of diaphragm 228 is sandwiched between the recessed top surface of the valve body member 221 and the bottom surface of the inner cylindrical flange 218 of the first body member 213.

Similarly, the diaphragm 229 is, at its periphery, sandwiched between the bottom face of the cylindrical valve body member 221 and the upwardly facing surface of a cylindrical flange 235 provided in a valve cap member 236. Valve cap member 236 has an inwardly facing cylindrical wall portion threaded to mate with the respective end of the cylindrical valve body member 221 and the flange 235 is concentric therewith and spaced therefrom by an annular space. Inboard of the flange 235, the cap member 236 is dished to provide room for movement of the diaphragm 228 thereby defining a chamber 237 between the diaphragm 228 and the top wall of the cap member. A gas inlet passage 238 communicates from the exterior of the cap member to said chamber 237 and is provided with a suitable end fitting for receiving a connection to a conduit for the supply of gas thereto.

The control member 234 is provided with four radially outwardly protruding flanges spaced along its length. There are two end flanges 239, 240 at opposite ends thereof and two intermediate flanges 241, 242 located such that the central boss of each diaphragm 228, 229 is trapped between an end flange and an intermediate flange.

A cylindrical collar 243 extends upwardly from the flange 242 to approximately half way between flange 242 and flange 241 spaced from the control rod 234 by an annular gap 244. A bore 245 extends through the control member 234 from the chamber 237 running axially of the control member until just within the annular gap 244 between the control member 234 and the cylindrical collar 243. The bore then exits transversely from the control member on the side thereof opposite to the bore 225 of the valve body member 221 and in a direction somewhat toward the outlet from the annular space 244.

It can be seen that coil spring 220 serves to bias the diaphragm 228 to close the valve seat 226 with the frusto conical valve member surface 232.

The valve has a subsidiary role as a pressure relief valve. Excessive pressure in the buoyancy chamber will be communicated into the chamber 237 and will force up the diaphragm 229 whilst also acting on the valve member surface 232 to open the venting valve. The pressure relief action may take place at chamber pressure of 7 to 14 KPa (1 to 2 psi) above ambient.

In use, to vent gas from the interior of the boat, air pressure is applied to conduit 238 from a suitable supply of pressurised air at, for instance about 830 kPa (120 psi).

The effect of this is two fold. First, the chamber 237 is sufficiently pressurised to deflect diaphragm 229 and hence diaphragm 228 upwardly to lift the valve member surface 232 off the valve seat 226 and open the valve provided by those members. This allows gas flow from the boat through the bore 225 and the valve means 226, 232 through the apertures 216, to atmosphere. In addition, air flows from the chamber 237 through the bore 245 to join the main flow path of gas entering through bore 225. It has been found that a venturi effect is produced which greatly assists evacuation of the boat.

The extent of the venturi effect obtained depends to a substantial extend in practice upon the exact construction of the air bleed provided by the bore 245. It has been found very advantageous that the exit from the bore 245 is directed away from the bore 225 and that the exit is situated close to the intermediate flange 241. It has also been found advantageous that the cylindrical collar 243 does not extend substantially more than half way between the two intermediate flanges 241 and 242.

However, it is envisaged that many alternative constructions of the valve interior would produce the same effect. It may well be desirable to arrange that the flow of gas through the bore 245 can exit into the main flow path substantially directly upwardly toward the valve 226, 232 rather than through the side of the control rod 234 as illustrated. This might for instance be achieved by supporting the intermediate flange 241 by a spider connecting it to a shorter control rod 234 with the bore 245 extending axially throughout the control rod 234 to the end thereof at said spider.

In use in the inflatable boat, the conduit 238 is preferably connected via flexible tubing to a common operating point serving a number of such venting valve and provided on the boat hull membrane surface. Suitable connecting means are provided for connecting the operating point to the control unit 102. Preferably a non-return valve is included either in the flexible conduit or at the operating point. A manually operated gas connection to the common operating point may be provided and used to serve a multitude of venting valves of the kind illustrated so that a single person may operate all of the venting valves together to provide rapid deflation of the boat.

Figure 6:
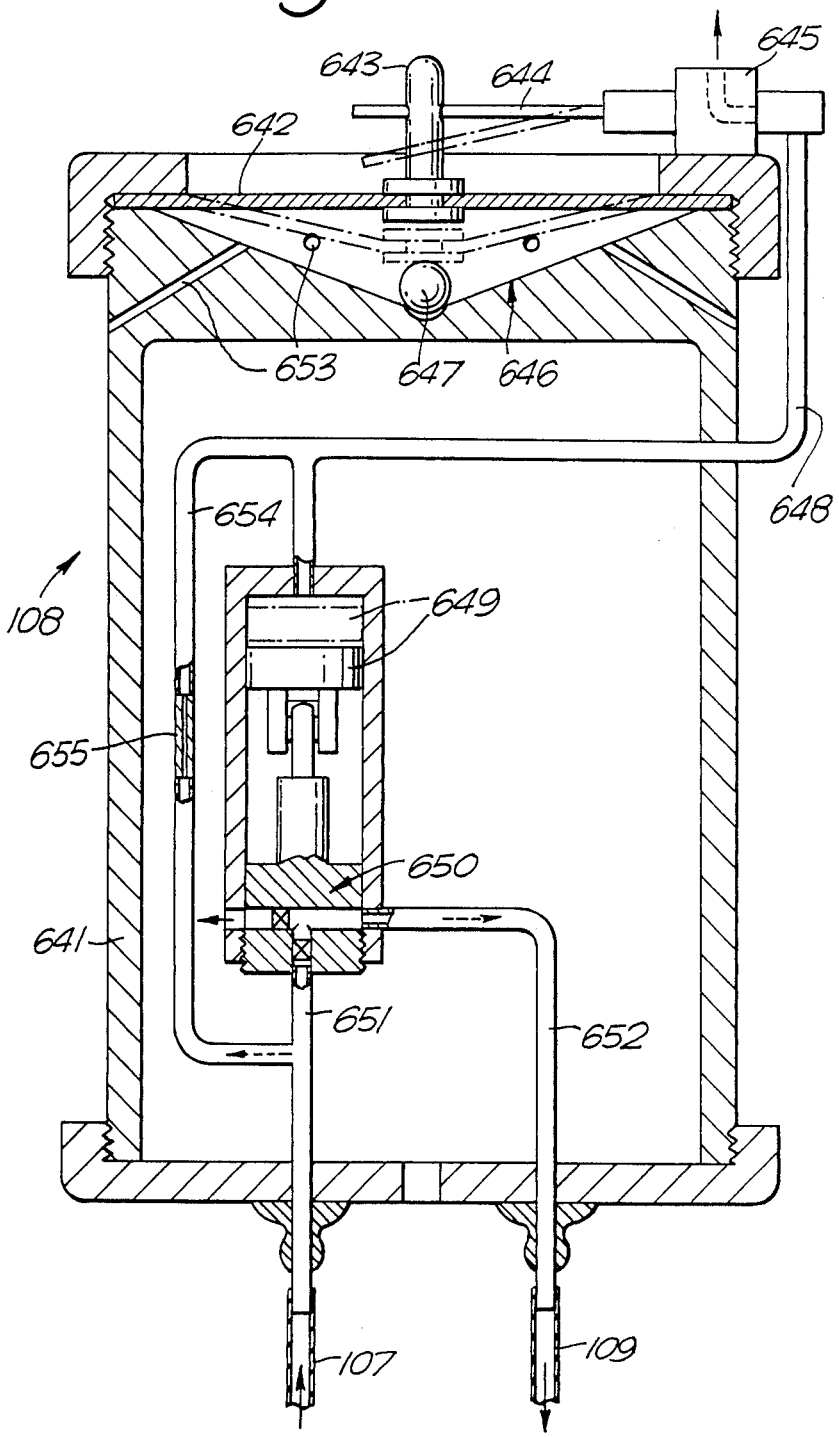
FIG. 6 is a schematic internal view of a second form of ascent control valve of use in the invention, which is usable also as a descent control valve.

Such valves are further described in WO-87/06557 and a second example is shown in FIG. 6.

Figure 3:
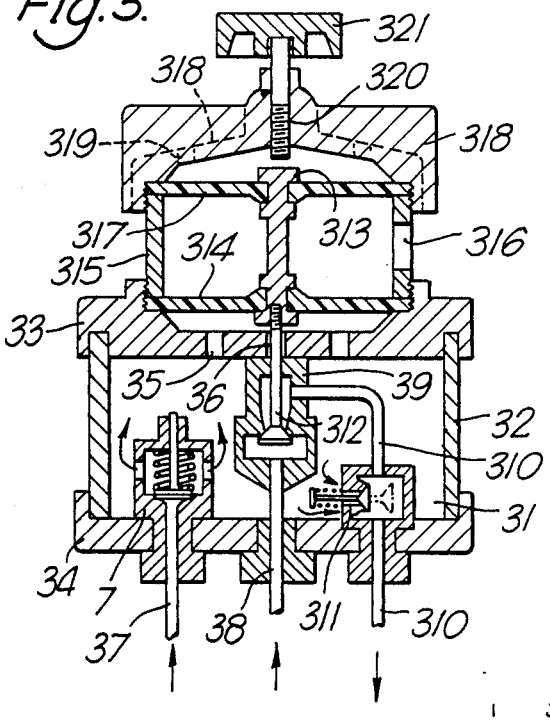
FIG. 3 is a cross-section through a depth limiting valve for use in the craft according to FIG. 1.

A depth limiting valve for use in the invention is shown in FIG. 3.

A gas reservoir, generally indicated at 31 is formed by a short length of cylindrical tube 32 closed at each end by base caps 33, 34. The upper base cap 33 has a plurality of axial holes 35 extending therethrough. These holes are arranged in a ring concentric with the base cap. A further axial hole 36 extends through the centre of the base cap 33. The lower base cap 34 is provided with a Schrader-type tire inflation valve 37 through which air can be admitted into or discharged from the reservoir 31 via a pipe 37'. An air supply pipe 38 extends through the base cap 34 to a poppet valve 39 which is attached to and depends from the centre of the upper base cap 33. An air outlet pipe 310 also extends through the base cap 34 to communicate with the outlet of the valve 39. A relief valve 311 is provided within the reservoir 31 to permit discharge of air from the reservoir through the pipe 310 if the air in the reservoir exceeds a predetermined maximum pressure. For example, said pressure can be in the range 552 to 690 KPa (80 to 100 lbs. per square inch).

An operating stem 312 of the valve 39 extends through the central hole 36 in the base cap 33 to protrude from the upper surface of the base cap. The protruding end of the stem 312 is threaded and is threadably received in the base of a co-axial spindle 313. The base of the spindle is secured to a lower diaphragm 314 which extends radially beyond the ring of holes 35. The periphery of the diaphragm 314 is clamped in fluid tight manner between the base cap 33 and an upper cylindrical tube 315 threadably connected thereto. The tube 315 has a plurality of circumferentially spaced holes 316 to permit ingress of water.

The other end of the spindle 313 is secured to the centre of a second diaphragm 317 which is secured at its periphery between the upper tube 315 and a top cap 318 threadably received thereon. This second diaphragm 317 is provided to stabilise the action of the lower diaphragm 314. The top cap 318 has several holes 319 extending axially therethrough to allow ingress of water into the chamber formed between the upper diaphragm 317 and the top cap 318. In that manner, both surfaces of the upper diaphragm 317 are exposed to the same water pressure. Strengthening ribs 318' are provided on the top cap 318.

Optionally, a threaded bore 320 is formed through the centre of the top cap 318 to receive a manually operable turn screw 321. The lower end of the turn screw 321 is aligned with the upper end of the spindle 313 whereby clockwise rotation of the turn screw causes the screw to bear down on the spindle.

The depth at which the limiting valve is to operate is determined by the pressure of air within the reservoir 31. Air is introduced into the reservoir 31 by, for example, a foot pump or compressed air line attached to the pipe 37'. If the pressure exceeds the maximum intended operating pressure, the relief valve 311 operates to exhaust air through the outlet pipe 310. Air pressure within the reservoir 31 can be adjusted as required.

During storage or normal use, the air pressure within the reservoir 31 acting on the lower surface of the lower diaphragm 314 is greater than the ambient fluid pressure acting on the upper surface of the diaphragm 314. As a result, the diaphragm 314, when viewed from below, is maintained in a concave configuration and the stem 312 is maintained in an extended position whereby the valve 39 is closed isolating the inlet pipe 38 from the outlet pipe 310. However, when a depth is reached at which the water pressure exceeds the reservoir air pressure, the diaphragm 314 will be flattened by the excess water pressure thereby moving the stem 312 downwardly and opening the valve 39. When the valve 39 opens air is permitted to pass from the inlet pipe 38 through the outlet pipe 310 and hence to the descent control valve or hover control valve. When the boat next rises such that the water pressure has been reduced to a pressure below that of the air in the reservoir 31, the diaphragm will again adopt its concave configuration moving the stem 312 upwardly and thereby once again closing the valve 39.

Such valves may be used as valves 112 and 117 and are further described in GB-2111174B.

Referring to FIG. 4 of the drawings, an ascent control valve generally indicated at 108 comprises an outer body 42 having a central passage 43 which is threaded to receive line 109 as an inlet for gas to the valve. Onto the outer body 42 there is threaded a housing 47 having a transverse wall 48 which bounds a lower chamber 49 and an upper chamber 410. In the lower chamber 49 there is positioned a sealing plate 411 having an annular rib 412 on which rests a resiliently deformable diaphragm 413. The upper face of the diaphragm 413 is exposed to an residual fluid pressure present in the chamber 49. A pressure regulator 118 in line 107 transmits a reduced gas pressure via a branch line 119 to the inlet in the base of the ascent control valve. The under side of the diaphragm is in use subject to the fluid pressure in line 119, through passages 414 between the sealing plate 411 and diaphragm 413, and the space below the diaphragm via holes 415 in the wall of the housing 47 communicating with a connection (not shown) to line 109. In the chamber 49, below the diaphragm 413, there is disposed a seal cap 416 which is urged downwardly by a compression spring 417, so as normally to seat onto the top of the body 42. The seal cap has a wide central aperture 418 within which there is disposed with clearance a stem 419 secured to the diaphragm 413 and which carries at its lower end a valve member 420 which in the rest condition seats onto a seating 421 on the seal cap 416 and prevents exit of gas fluid from line 107.

The chamber 49 communicates, through a passage 423 with an air supply controlled by a valve.

The valve has a snap-on connector 424 to receive an air hose (not shown) connected to line 107 which contains a higher pressure than line 119. From the connector 424, an air passage 425 leads through a filter 426 and a passage 427 to a piston chamber 428. The passages 425 and 427 are formed in a nut 429 threaded into a valve body 430, with an "O-ring" 431 between them. The piston chamber 428 formed in the body 430 contains a spacer washer 432 against which is seated an O-ring 433 abutted by one end of a spacer cage 434. The other end of the spacer cage abuts an O-ring 435 seated against a spacer washer 436 abutting a union 437 threaded into the body 430. Within the spacer cage 434 there is positioned a piston 438 having a first larger air passage 439 leading to a second smaller air passage 440 which opens into a space 441 containing a spring 442 which thrusts the piston to the right in this drawing. The space 441 opens into a slightly smaller passage 443 containing a spring 444, which thrusts a valve 445, on one end of a rigid actuator rod 446, into a closed position. At the other end of the rod 446 there is mounted a velocity disc plate 447.

When the whisker valve 445, 446 is closed, i.e. when the velocity member 447 is not deflected by rush of water against it, or is not deflected to a predetermined extent, the air pressures on each end of the piston 438 are balanced, and the spring 442 thrusts the piston into a closed position (to the right in this drawing) in which the piston closes off the passage 423. If the whisker valve is opened, as a result of deflection of the velocity member 447, there is a lowering of pressure in the space 441, with the result that the unbalance of pressures on the piston causes it to move to the left, in this drawing, thereby providing a flow path for gas to the passage 423 and permitting flow of air down the passage 423, to deflect the diaphragm 413 downwardly for actuation of the venting valve. As soon as deflection of the velocity member is terminated, as a result of reduction of buoyancy and thus of speed of rise in the water, the whisker valve closes again, and pressure at both ends of the piston become equalised, so that the spring 442 then returns the piston to the right and thereby closes off the passage 423.

The chamber 410 in which the velocity member 447 is positioned has an opening 448 through which the upper face of the velocity member 447 is exposed to the relative downward movement of water as the entire device rises under the effect of buoyancy. When the rate of rise exceeds a predetermined limit, the velocity member 447 permits entry of air to chamber 49. This depresses the diaphragm 413 and causes valve member 420 to be lowered away from the seating 421, thereby providing an escape path for air from the line 107 past the seating 421, and out through the passages 415 into line 109 to venting valve 106. This escape of air from the lifting bag decreases the rate of ascent, and the force exerted on the velocity member 447 is accordingly reduced, so that the valve 445 eventually closes and the diaphragm 413 is allowed to return to its unconstrained condition and thereby lift the valve member 420 into sealing engagement with the seat 421.

A tapping 448 off the air passage 423 enables the pneumatic control signal produced by deflection of the velocity member 417 to be communicated to other venting valves on the craft on the craft at their inlets 238.

Similar valves readily adapted for use in this invention are described in GB-2126534B.

Figure 5:
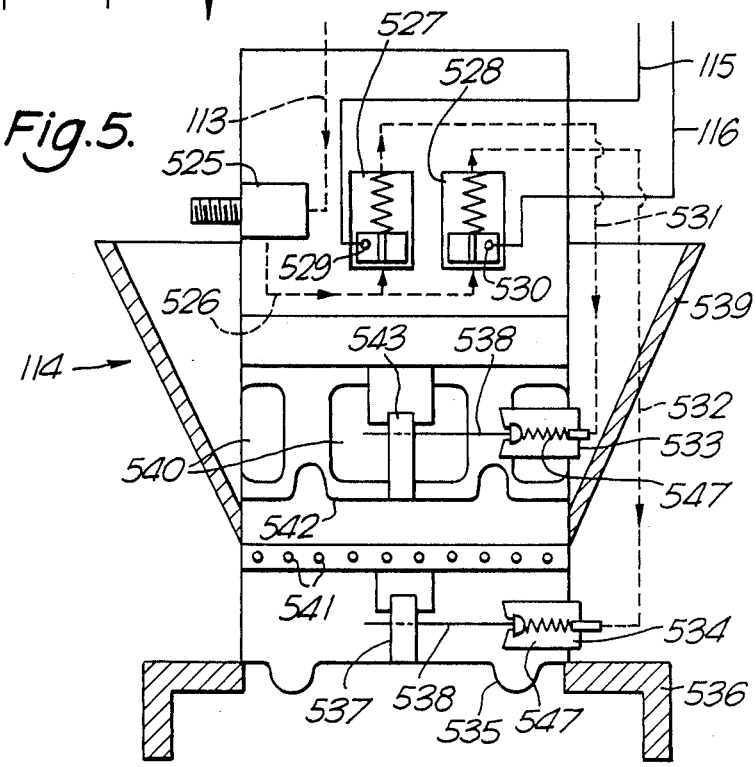
FIG. 5 is a cross-section through a hovering control valve for use in the craft according to FIG. 1.

A first example of a hover control valve 114 is shown in FIG. 5.

Gas line 117 leads to a regulator 525, the function of which will be explained in due course. However, regulator 525 produces a reduced constant pressure which is supplied through line 526 to a pair of piston valves 527, 528. Each piston valve comprises a cylinder which contains a piston biased to a closed position in which it closes outlets 529 and 530 respectively in the cylinder wall of the piston valves. Each piston has a gas bleed bore therethrough enabling slow equilibration of gas pressure on each side of the piston. Displacement of the piston in the valve concerned exposes the respective outlet so that gas may pass from the line 526 out of the respective outlet. However, each piston divides its respective cylinder into a pair of variable volume chambers. Gas seeks to pass from the regulator into an inlet chamber of each valve displacing the piston to expand the volume of the inlet chamber whilst diminishing the volume of the second chamber of the valve. This is resisted by the sealing of each second chamber against gas outflow. Lines 531 and 532 are connected as outlets for the second chamber of each of the valves 527 and 528 and lead to a pair of whisker valves 533 and 534 respectively which are normally closed.

Whisker valve 533 is associated with means to detect upward movement of the apparatus in the water and whisker valve 534 is associated with means to detect downward movement of the apparatus in the water.

Each whisker valve 533, 534 comprises a circular valve seat surrounding a bore through which passes a stem 538 of a valve member having a head, e.g. a mushroom head, seating on the valve seat. Deflection of the stem causes the head to become lifted from the valve seat on one side to open the valve. Each valve member is biased to seat by a coil spring 547 acting against the head.

The means for detecting downward movement of the apparatus in the water comprises a diaphragm 535 sealing an aperture in a downward facing scoop 536. Diaphragm 535 carries at its centre a pillar 537 mounted for reciprocating movement with the diaphragm. A rod 538 extends transversely from the pillar 537 and terminates in the valve member of whisker valve 534. Displacement of the diaphragm causes displacement of the valve member of whisker valve 534 from its seating to open the valve. This results in opening of the gas line 532 communicating with the second chamber of valve 528 which in turn will allow the movement of the piston in valve 528 to communicate the inlet gas pressure to that valve with the outlet of the valve and with line 116 which is connected to inflation valve 104.

The means for detecting upward movement of the apparatus in the water is similar and comprises an upwardly facing funnel 539 for deflecting water flow into the interior of the housing through apertures 540. Water which has flowed through the funnel 539 can escape to the exterior of the housing through apertures 541 formed in a ring around the base of the funnel. Means may be provided to selectively close or partially close the apertures 541 such as a ring rotatable to obscure some or all of the apertures. The ring may be mounted in threaded engagement with the exterior of the housing for longitudinal movement on the housing to progressively obscure apertures 541.

Water flowing through the funnel and through the apertures 540 acts on a diaphragm 542 extending across the housing and carrying at its centre a pillar 543 bearing a respective stem 538 terminating in the valve member of whisker valve 533. Upward movement of the apparatus in the water causes displacement of the diaphragm 542 and unseating of whisker valve 533 opening gas line 531 which allows movement of the piston in valve 527 to communicate the inlet gas pressure with the outlet of the valve which is connected to line 115.

The overall operation of the apparatus is as follows.

In use the boat sinks until a depth is reached such that the water pressure deflects the diaphragm of the depth limiting valve 117 causing a communication of the outlet pressure of the control unit 102 and the regulator 525 to the valves 527, 528. As the apparatus is descending at this time, diaphragm 535 will be deflected upwardly and whisker valves 534 will be unseated. This will enable gas to vent from the chamber of valve 528 deflecting the piston therein. There will be no back resistance because line 532 is opened by the whisker valve 534. Gas will therefore pass through the valve 528 out through its outlet 530 into line 116 to inflation valve 104 increasing the buoyancy of the boat. Eventually, the boat will cease to descend and will probably commence ascending. At this point, whisker valve 534 will reseat, pressure will equalise on each side of the piston in valve 528 and the biasing in the valve will move the piston in the valve 528 to close the outlet 530 thus cutting off pressure from line 116. If upward movement is sensed by the diaphragm 542, this diaphragm will be deflected downwardly unseating whisker valve 533 which will result in the operation of valve 527 which will open to allow passage of gas from regulator 525 through the outlet 529 into line 115. Gas pressure in line 115 will open valve 106 venting the air in the chamber. The ascent will eventually stop. If the boat commences to descend, the previously described sequence of operation upon descent will occur and the buoyancy will increase. The device will accordingly eventually reach a stable depth which will be maintained.

Hover control valves adaptable for use in the invention are further described in WO85/03049.

An alternative form of ascent control valve for use in the invention is shown in FIG. 6. This valve is also suitable for use as the descent control valve 110.

Referring now to FIG. 6, an ascent control device of a second type is generally indicated at 108 and is attached to the top wall of the craft 100 (not shown). The device comprises an elongate housing 641 which is open at its upper end to expose the upper face of a diaphragm 642. The diaphragm 642 has a central actuating stem 643 extending upwardly therefrom and movable therewith. The stem 643 has a lateral hole which receives the whisker 644 of a whisker valve 645. The valve 645 is a normally closed two-way poppet-type whisker valve arranged to exhaust to its surroundings. The inlet is connected to an air exhaust line 648.

A tapered seat 646 and ball 647 are provided below the diaphragm 642. Circumferentially spaced holes 653 communicate between the chamber under diaphragm 642 and ambient fluid.

The exhaust line 648 extends from a single acting spring return pilot actuator 649 arranged to act on a normally open three-way spool valve 650. The inlet of valve 650 is connected to air supply line 107 and the outlet is connected by line 109 to the pneumatically operated venting valve 106. A by-pass 654 including restrictor 655 connects the supply line 651 upstream of the valve 650 to the exhaust line 648.

In use, air supplied from the supply line 651 via the by-pass 654 maintains the actuator 649 in its extended position in which it bears against the operating stem of valve 650 to vent the line 652. When the diaphragm 642 is moved downwardly in response to ascent of the device to a sufficient extent to open the whisker valve 645, air is permitted to exhaust from the actuator 649 via the exhaust line 648. The piston of the actuator returns under its spring bias releasing the operating stem of the valve 650 and allowing the valve to return to its normal open condition in which it connects lines 651 and 652. The air passing through line 652 actuates the venting valve to vent air from the craft.

The venting of air reduces the craft's buoyancy and thereby decelerates ascent. The diaphragm 642 will then gradually return to its normal position and thereby close the whisker valve 645. Closure of the valve will cause a build up of air pressure in the pilot actuator 649 moving the piston of that actuator to close the valve 650. Closure of the valve 650 vents the line 652 thereby reducing pressure in the venting valve and allowing that valve to close.

Figure 7:
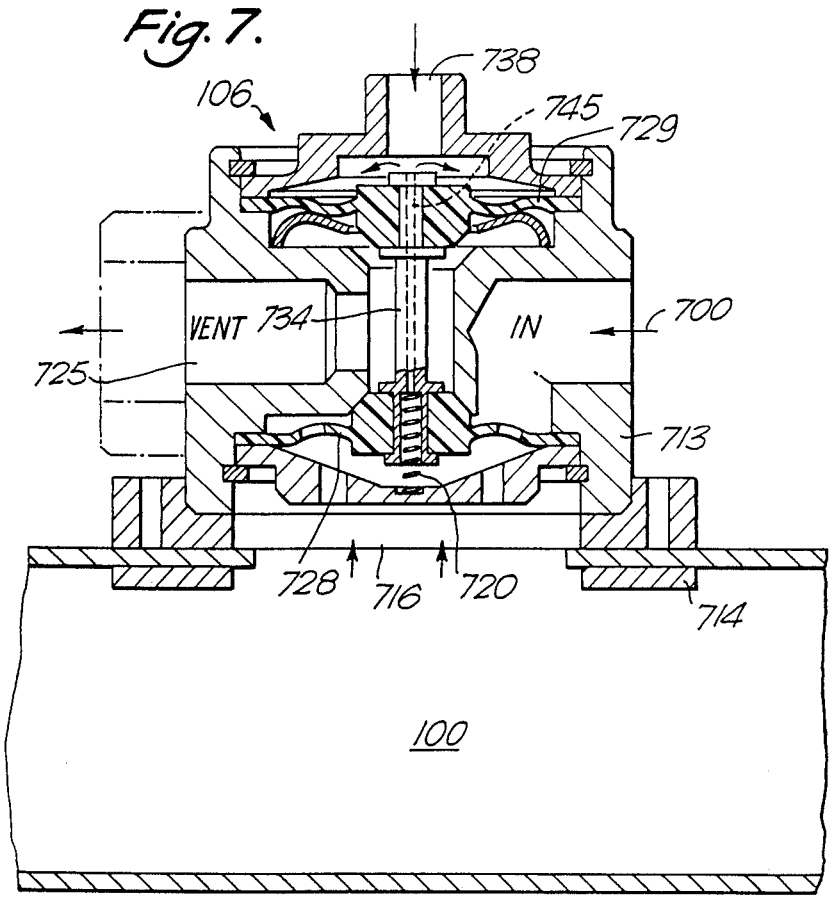
FIG. 7 is a cross-section through a second example of a venting valve for use in the invention.

An alternative form of venting valve 106 is shown in FIG. 7. The valve differs from that of FIG. 2 in being intended for mounting outside the inflatable buoyancy chamber of the craft 100. The passage 745 extends axially through the whole length of control rod 734. A further inlet 700 is provided in the side of the valve opposite the venting passage 725 which in this embodiment operates as an outlet, the venting flow being reversed with respect to FIG. 2. Inlet 700 communicates with the interior of the buoyancy chamber of the craft 100 via the openings in diaphragm 728. Inflation air may therefore be injected through inlet 700 from a source of compressed air. Thus inlet 700 may be connected to the outlet of the hover control valve 114 and the descent control valve 110.

Air pressure applied to inlet 738 will deflect the diaphragm 729 downwardly to open the venting valve because although the applied pressure is communicated to behind diaphragm 728 by the bore 745, the pressure acts of a greater area of diaphragm 729. This valve also acts as a pressure relief valve as excessive air pressure in the inflatable buoyancy chamber is communicated up to above diaphragm 729 via bore 745 and forces the valve open, the line connected to inlet 738 being closed upstream at each valve to which the venting valve is connected.

Figure 8:
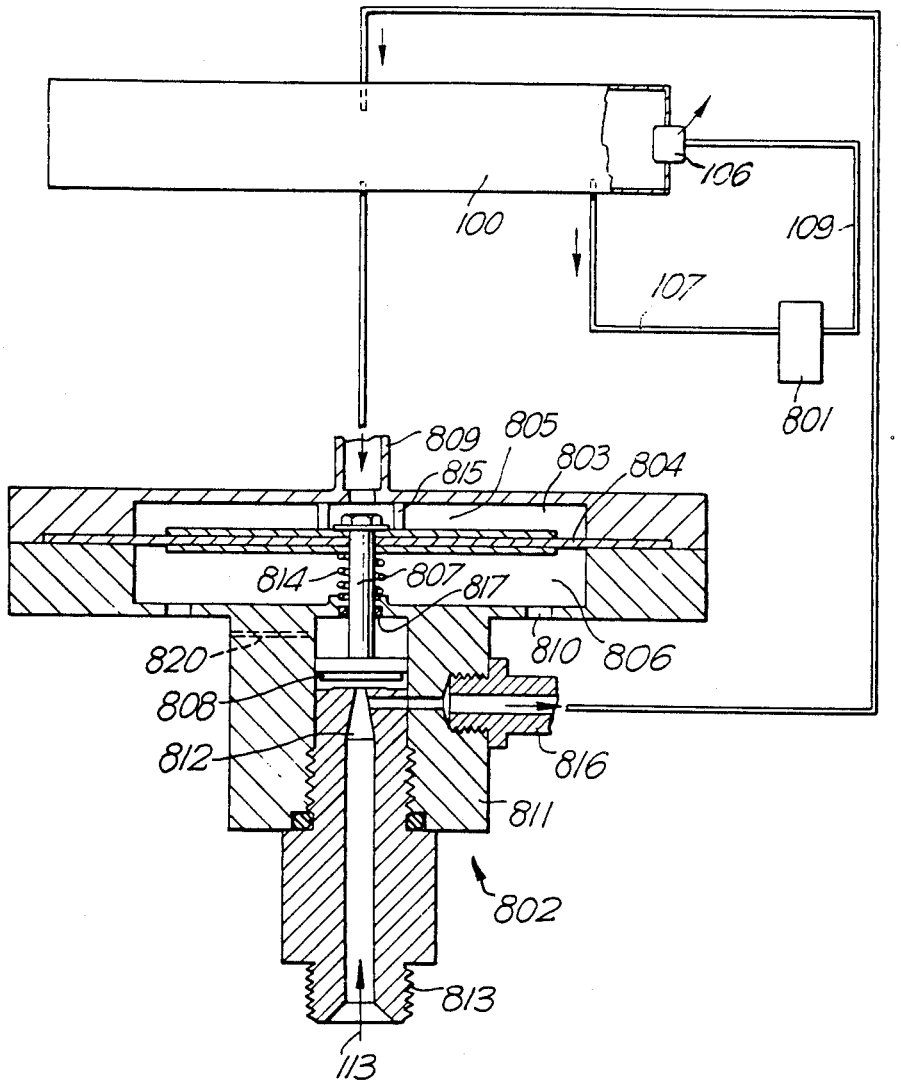
FIG. 8 is a cross-section through a second form of hovering control valve for use in the invention.

The hovering control shown in FIG. 8 is substantially different in structure and its connections compared to the hovering control 114 of FIGS. 1 and 5. It comprises an ascent control valve 801 of the same structure as the ascent control valve 108 shown in FIG. 6 connected with its inlet for operating air pressure connected to the buoyancy chamber of the craft 100 and with its outlet for communicating a pneumatic signal connected to the actuating inlet 238 or 738 of a venting valve 106 as illustrated in FIG. 2 or FIG. 7.

The hovering control further comprises an inflation pressure control valve 802 connected between line 113 from the control unit and the buoyancy chamber of the craft 100.

The valve 802 comprises a diaphragm chamber 803 divided by a flexible diaphragm 804 into upper chamber 805 and lower chamber 806. Diaphragm 804 carries a depending valve stem 807 terminating in a disc shaped valve washer 808. An inlet for gas pressure from the craft 100 is provided at 809 in the upper chamber 805. Lower chamber 806 communicates with ambient water pressure via ports 810.

Valve stem 807 extends out of the lower chamber 806 axially along a large diameter tube 811. A needle jet 812 enters tube 811 from the opposite end and communicates with an inlet 813 for gas from line 113.

The centre of diaphragm 804 is biased upwardly by a coil spring 814 to rest against an annular stop 815. The diaphragm centre is displaceable downwardly to lower the valve washer 808 on to the needle jet 812 to block it.

An outlet 816 for air communicates with the interior of tube 811 and is connected to the inlet of the buoyancy chamber. Air can flow from line 113 to outlet 816 when the valve stem 807 is raised by spring 814.

Tube 811 is sealed from the ambient water pressure in lower chamber 806 by an O-ring 817.

In use starting from a hovering condition the buoyancy chamber is inflated by air flowing through line 113 until the pressure in the chamber is sufficient to depress diaphragm 804 and shut off the needle jet 812. Typically a pressure about 41 KPa (6 psi) above ambient is desirable. The supply of air through line 113 may be regulated at a much higher pressure, e.g. 690 KPa (100 psi) above ambient. The size of the buoyancy chamber is so chosen with respect to the weight of the craft that there will now be some small degree of positive buoyancy. The craft will begin to ascend. When the rate of ascent is sufficient, the diaphragm of the ascent control valve 801 will deflect and the pressure in the buoyancy chamber will be communicated from valve 801 as an actuating signal to the venting valve 106 causing some of the buoyancy in the chamber to be dumped. This will result in the ascent slowing and valve 801 switching off the dumping. The rate of dumping can be designed to be sufficient to produce slight negative buoyancy producing a slight descent. As the pressure in the chamber will have dropped toward ambient, the diaphragm 804 will rise and reinflation of the buoyancy chamber will commence. The craft will therefore oscillate gently up and down about a baseline depth. An amplitude of oscillation of only about 30 cm can easily be obtained.

Many modifications and variations of the above embodiment may be made within the scope of the invention.

I claim:

1. A water craft including an inflatable buoyancy chamber, by inflation and deflation of which buoyancy chamber the buoyancy of the craft floating or submerged in water may be regulated, buoyancy control apparatus for controlling inflation and deflation of said buoyancy chamber, and a source of compressed gas connected via said control apparatus to said buoyancy chamber, wherein said buoyancy control apparatus comprises:

(1) means responsive to a control signal for producing venting of said buoyancy chamber;

(2) buoyancy increasing means for introducing gas from said source of compressed gas to said buoyancy chamber;

(3) means for controlling the descent of the craft in water, including means for sensing when the rate of descent exceeds a predetermined value, and providing inflation gas to said buoyancy increasing means when said rate of descent exceeds said predetermined value;

(4) means for controlling the ascent of the craft in water and including means for sensing when the rate of ascent exceeds a predetermined value and providing a control signal to activate said venting means when said rate of ascent exceeds said predetermined value;

(5) means for producing hovering of said craft submerged in water by intermittently admitting gas through said buoyancy increasing means and intermittently venting gas through said venting means to counteract downward and upward motion respectively of said craft; and (6) operator actuable control means for actuating selected ones of said venting means, buoyancy increasing means, descent control means, ascent control means and hover means to select between the functions of descent at a controlled rate, ascent at a controlled rate, and hovering.

2. A craft as claimed in claim 1, wherein the buoyancy control apparatus further includes means for delaying actuation of the descent control means, ascent control means and/or hover means after the operation by the operator of the operator actuable control means to select a said function until a preselected depth has been reached.

3. A craft as claimed in claim 1 wherein the ascent control means comprises means monitoring the rate of ascent sensitive to reactive thrust of water on the said means consequent upon the rate of ascent and providing a control signal when the ascent speed exceeds a predetermined value, and a gas control valve responsive to said signal to provide a pneumatic actuation signal to said venting means, connected to said venting means, said venting means being responsive to said signal to vent gas from the chamber to reduce the buoyancy and comprising a pneumatically actuable venting valve adapted to vent gas from the gas chamber when actuated.

4. A craft as claimed in claim 3, wherein the monitoring means comprises a diaphragm exposed at one face to the ambient water in use and so disposed that movement of the device in the ascent direction urges the diaphragm to deflect.

5. A craft as claimed in claim 4, wherein the other face of the diaphragm also is open to ambient water.

6. A craft as claimed in claim 4, wherein the control signal is provided by movement of a actuating member extending from and movable with the diaphragm.

7. A craft as claimed in claim 6, wherein the actuating member acts directly on the gas control valve.

8. A craft as claimed in claim 7, wherein the gas control valve is a normally closed two-way poppet-type whisker valve in which the whisker is engaged by the actuating member.

9. A craft as claimed in claim 1, wherein the ascent control means is a device having means for monitoring the rate of ascent of the buoyancy apparatus and providing a control signal when the ascent velocity exceeds a predetermined value, the device being connected to said venting means controlling the venting of gas from the gas chamber, said venting means being responsive indirectly to said control signal to vent gas from the chamber to reduce buoyancy, wherein the monitoring means has a velocity member exposed to upward flow of water relative to the craft supported in an equilibrium position for deflection by said upward flow of water, said velocity member being exposed at one face to the water whereby sufficiently rapid movement of the device in the ascent direction urges movement of the velocity member to produce said control signal, wherein the monitoring means also comprises a control valve comprising an inlet for connection to a source of pressurised gas, a chamber communicating with said inlet and containing a piston moveable between a valve-closed position and a valve-open position, a gas supply line for communicating said control signal to said venting valve means exiting from said piston containing chamber, there being a flow path for gas from said inlet to said gas supply line which is shut off from said inlet when the piston is in the valve-closed position and opened for gas flow from said inlet when the piston is in the valve-open position, a valved outlet for said piston containing chamber remote from the said inlet and normally closed by a valve, said valve being operable by movement of said velocity member to open the valve, gas bleed means providing restricted gas communication from said inlet to the face of the piston remote from the inlet, and biassing means biassing the piston to the valve-closed position, whereby upon opening of the valve which normally closes said valved outlet by movement of the velocity member the piston is displaced to the valve-open position by gas pressure from said inlet to communicate said inlet and said gas supply line, and wherein the venting valve means controlling the venting of gas from the gas chamber is responsive to gas pressure in said gas supply line to produce said venting.

10. A craft as claimed in claim 9, wherein the velocity member has a rigid actuating member extending from it and movable with it to act directly or indirectly on the control valve.

11. As craft as claimed in claim 9, wherein the valve for said valved outlet of said piston containing chamber is a whisker valve having a valve stem connected to the velocity member and a valve head and seat adapted to be unseated by deflection of the valve stem.

12. A craft as claimed in claim 9, wherein the venting means is a valve including a chamber connected to said gas supply line, said chamber being bounded by a flexible diaphragm operable to open the venting means upon increase of pressure in the chamber.

13. A craft as claimed in claim 9, wherein the venting means is a valve including a chamber connected to said gas supply line, said chamber being bounded by a piston movable in a cylinder, said piston being operable to open the venting valve means upon increase of pressure in the chamber.

14. A craft as claimed in claim 1, wherein the descent control means comprises means monitoring the rate of descent sensitive to reactive thrust of water on said means consequent upon the rate of descent and providing a control signal when the descent speed exceeds a predetermined value, and a gas control valve responsive to said signal to release gas to said buoyancy increasing means.

15. A craft as claimed in claim 1, wherein the venting means is a remotely pneumatically actuated venting valve apparatus.

16. A craft as claimed in claim 15, wherein the venting valve apparatus comprises a main gas flow path which extends from an inlet to the venting valve apparatus for vented gas to an outlet from the venting valve apparatus, a valve normally closing said flow path, and actuating means for opening said valve, wherein there is a subsidiary flow path extending from a subsidiary gas inlet to a subsidiary gas outlet opening within the main flow path upstream of the valve, so constructed and arranged that application of gas pressure to said subsidiary inlet will produce or enhance flow of vented gas through said main flow path when said valve is open.

17. A craft as claimed in claim 16, wherein, in said venting valve apparatus, the arrangement is such that the production or enhancement of gas flow is due to a venturi effect.

18. A craft as claimed in claim 16, wherein the subsidiary flow path communicates with a variable volume chamber, having a movable wall portion to which is mounted a control member connected to open said valve upon movement of said wall portion by pressurisation of said chamber, said subsidiary flow path extending from upstream of said wall portion to downstream of said wall portion.

19. A craft as claimed in claim 18, wherein there is a bore through a portion of the control member constituting a portion of the subsidiary flow path and extending from the chamber to downstream of the movable wall portion.

20. A craft as claimed in claim 19, wherein the said bore exits from the control member in a region where the control member is surrounded by a shield member for deflecting gas flow from the control member toward the valve.

21. A craft as claimed in claim 2, wherein the means for delaying activation until a preselected depth has been reached serves to interrupt the gas supply to the descent control means, ascent control means or hover means until the required depth has been reached.

22. A craft as claimed in claim 21, wherein the means for delaying activation comprises a pressure sensitive gas supply device, incorporating a gas supply valve and adapted to open the gas supply valve when the device reaches a predetermined depth in water, comprising (i) a substantially fixed volume, closed gas reservoir containing a quantity of gas at substantially a predetermined pressure, (ii) pressure sensing means monitoring the difference in pressure between gas in said reservoir and the ambient fluid, said sensing means providing a control signal when the pressure of the ambient fluid exceeds the pressure of the gas reservoir, and (iii) a gas supply valve which is responsive to said signal to become opened.

23. A craft as claimed in claim 22, wherein a said gas supply valve is connected in gas supply lines to two or more of the ascent control means, descent control means, and hover means.

24. A craft as claimed in claim 22, wherein said pressure sensing means comprises a flexible diaphragm which has one major surface exposed to the ambient water and which has its other opposed major surface exposed to the gas of the gas reservoir.

25. A craft as claimed in claim 24, wherein the gas reservoir has a wall with an opening or openings therein, and said diaphragm is mounted on said wall covering the or each said opening.

26. A craft as claimed in claim 24, wherein a rigid actuating member extends from and is moveable with said diaphragm, said actuating member acting on said gas supply valve.

27. A water craft as claimed in claim 1, wherein said means for producing hovering comprises means for sensing descent and for providing sufficient inflation gas to said buoyancy increasing means to cause ascent, and means for actuating said venting means to cause descent following said action to provide inflation gas.

28. A water craft as claimed in claim 1, wherein said means for producing hovering comprises means for sensing upward motion and producing a control signal to actuate said venting means to cause descent and means for introducing inflation gas to said buoyancy increasing means to cause ascent following said action to cause descent.

29. A water craft as claimed in claim 1, wherein the means for producing hovering comprises means for sensing descent and for providing inflation gas to said buoyancy increasing means, and means for sensing ascent and for producing a control signal to activate said venting means.

* * * * *

UNITED STATES PATENT AND TRADEMARK OFFICE

CERTIFICATE OF CORRECTION

PATENT NO. : 4,945,851

DATED : August 7, 1990

INVENTOR(S) : BUCKLE

It is certified that error appears in the above-identified patent and that said Letters Patent is hereby corrected as shown below:

ON THE TITLE PAGE:

Change "[73] Assignee: Budyco (Divers) Limited, Colwyn Bay, United Kingdom" to -- [73] Assignee: Buoyco (Divers) Limited, Colwyn Bay, United Kingdom--

Signed and Sealed this

Thirty-first Day of December, 1991

*Attest:*

HARRY F. MANBECK, JR.

*Attesting Officer*

*Commissioner of Patents and Trademarks*